US006199925B1

(12) United States Patent
Alba

(10) Patent No.: US 6,199,925 B1
(45) Date of Patent: Mar. 13, 2001

(54) HIGH LOAD CAPACITY HOIST RING

(75) Inventor: Tony J. Alba, West Covina, CA (US)

(73) Assignee: CBC Industries, Inc., City of Commerce, CA (US)

( * ) Notice: Subject to any disclaimer, the term of this patent is extended or adjusted under 35 U.S.C. 154(b) by 0 days.

(21) Appl. No.: 09/339,466

(22) Filed: Jun. 23, 1999

(51) Int. Cl.[7] ..... B66C 1/66

(52) U.S. Cl. ..... 294/1.1; 294/89; 403/78; 403/164

(58) Field of Search ..... 294/1.1, 82.1, 294/89; 403/78, 79, 164; 410/101

(56) References Cited

U.S. PATENT DOCUMENTS

| | | | |
|---|---|---|---|
| Re. 33,490 | 12/1990 | Steinbock . | |
| 3,841,193 | 10/1974 | Ito . | |
| 3,866,492 | 2/1975 | Knoll . | |
| 3,886,707 | 6/1975 | Heldt . | |
| 4,075,932 | 2/1978 | Latham . | |
| 4,182,215 | 1/1980 | Green et al. . | |
| 4,213,333 | 7/1980 | Krieger et al. . | |
| 4,215,599 | 8/1980 | Batchelder et al. . | |
| 5,405,210 | 4/1995 | Tsui . | |
| 5,411,337 | 5/1995 | Bianco et al. . | |
| 5,466,025 * | 11/1995 | Mee | 294/1.1 |
| 5,743,576 * | 4/1998 | Schron, Jr. et al. | 294/1.1 |
| 5,823,588 * | 10/1998 | Morghen | 294/1.1 |
| 5,848,815 | 12/1998 | Tsui et al. . | |

* cited by examiner

*Primary Examiner*—Dean J. Kramer
(74) *Attorney, Agent, or Firm*—Bruce A. Jagger

(57) ABSTRACT

A high load capacity hoist ring assembly that can be installed to achieve the required tensile value in the mounting shank member without the use of a torque multiplier or hydraulic tensioning device. The assembly comprises a shank member, a compression member, a lifting loop having a transversely disposed pivot structure captively engaged by a retainer flange. Uniquely the retainer flange includes a plurality of threaded holes adapted to accept bolts which when torqued with a conventional torque wrench combine to achieve the required tensile value in the mounting shank. Load Capacity ratings start at about 10,000 lbs and can well exceed 100,000 lbs.

11 Claims, 5 Drawing Sheets

HIGH LOAD CAPACITY HOIST RING

BACKGROUND OF THE INVENTION

1. Field of the Invention

The invention relates in general to hoist ring assemblies and, in particular, to a high load capacity hoist ring assembly capable of being installed at a required tensile value to an object to be lifted without the use of either a torque multiplier or a hydraulic tensioning device.

2. Description of the Prior Art

Various high load hoist ring assemblies have been proposed previously. For Example, in Tsui et al U.S. Pat. No. 5,848,815, a safety hoist ring was proposed for lifting large loads. However, for a given hoist load capacity rating, the mount stud or shank member of the hoist ring assembly must be torqued to a predetermined value in order to pre-stress that member to the required tensile value. In order to properly pre-stress the shank member, the required tensile value should at least be equal the load capacity rating of the assembly, however, it is preferable that it be at least 1.5 times greater to assure against misuse, such as overloading the assembly, and the like. As the load capacity of the hoist ring assembly is increased, so to is the torque value required to achieve the proper tensile value in the shank member. For instance, a hoist ring assembly of the configuration disclosed in Tsui et al U.S. Pat. No. 5,848,815 having a load capacity rating of 50,000 pounds (lbs.), weighs about 87.5 lbs, and requires a torque value of 2,100 ft-lbs in order to achieve the required tensile value of 75,000 lbs in a shank member having 2½"–4 UNC threads. When the assembly is increased to a load capacity rating of 100,000 lbs, the assembly weighs 240 lbs, and requires a torque value of 6,800 ft-lbs in order to achieve a required tensile value of 150,000 lbs in a shank member having 3½"–4 UNC threads. These extreme torque values are impossible to achieve manually with conventional torque wrenches. Expensive torque multipliers or hydraulic tensioning devices are required. For instance, to achieve the torque value of 6,800 ft-lbs in the example above, a conventional torque wrench having a 3 foot moment arm would require the application of 2,266 pounds of pulling force to the wrench by the operator. Thus, as those skilled in the art recognize, the only practical method known to achieve these torque values requires the use of a torque multiplier in combination with a conventional torque wrench, or the use of a hydraulic tensioning device. Undesirably, such devices are expensive, often being twenty times as much, or more, than the cost of the hoist ring assembly itself. In addition, these devices are both heavy and bulky and thereby reduce the range of possible mounting locations for the hoist ring assembly.

It has been found that these problems arise when the desired torque requirements reach about 230 ft-lbs and above. This nominal torque value, 230 ft-lbs, is required when load capacity ratings of the hoist ring assemblies reach around 10,000 lbs.

Those concerned with these problems recognize the need for an improved high load capacity hoist ring assembly capable of being installed to the surface of an object to be lifted at its required tensile value without the use of a torque multiplier or hydraulic tensioning device.

These and other difficulties of the prior art have been overcome according to the present invention.

BRIEF SUMMARY OF THE INVENTION

It is one object of the present invention to provide a high load capacity hoist ring assembly that can be securely fastened to an object to be lifted at its required tensile value without the use of a torque multiplier or hydraulic tensioning device.

It is another object of the present invention to provide a high load capacity hoist ring assembly having a greater range of possible mounting locations on an object to be lifted.

A preferred embodiment of the high load capacity hoist ring assembly according to the present invention comprises a shank member, a compression member, a retainer flange, and a lifting loop captively engaged between the shank member and retainer flange for rotational and pivotal movement. The hoist ring has a transversely disposed pivot structure allowing the ring to swivel throughout 360 degrees and pivot approximately about 180 degrees thereto. Uniquely, the retainer flange has a plurality of threaded holes at spaced apart locations about an outer peripheral that is spaced from the longitudinal axis of the assembly. The holes extend through the retainer flange generally parallel to but spaced from the longitudinal axis of the assembly. The threaded holes are adapted to receive a plurality of bolts threadably engaging the holes and extending through the retainer flange. The bolts have jack ends that extend from the holes in the retainer flange to compressively bias the compression member upon installation of the assembly. Each bolt is adapted to separately receive a torque, and once received, the bolts in the aggregate achieve the required tensile value in the shank member without the need of a torque multiplier or hydraulic tensioning device. The bolts are simply individually torqued, preferably in a star pattern to an easily achievable value by manual operation of a convention torque wrench. There is no need to use a torque multiplier or hydraulic tensioning device to reach the desired torque values with the individual bolts. The effect of the torque applied to the individual bolts is, however, additive in generating the desired tension in the shank member.

Other objects, advantages, and novel features of the present invention will become apparent from the following detailed description of the invention when considered in conjunction with the accompanying drawings.

BRIEF DESCRIPTION OF THE DRAWINGS

The present invention provides its benefits across a broad spectrum of hoist ring assemblies. While the description which follows hereinafter is meant to be representative of a number of such applications, it is not exhaustive. As those skilled in the art will recognize, the basic apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

DETAILED DESCRIPTION OF THE PREFERRED EMBODIMENTS

Figure 1:
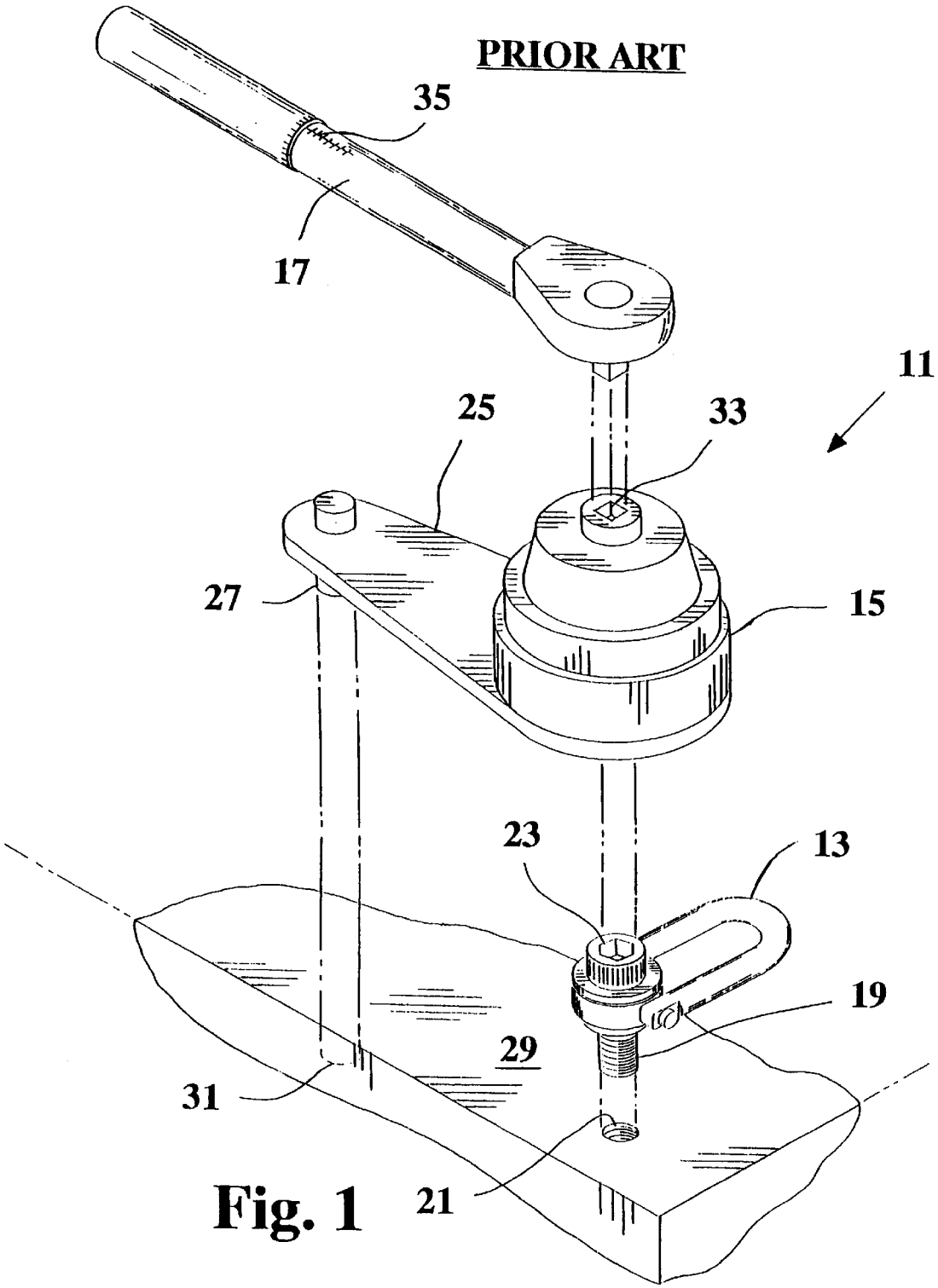
FIG. 1 is an exploded perspective view showing the installation of a prior art high load capacity hoist ring assembly with the assistance of a torque multiplier.

Referring to FIG. 1, there is shown generally at 11 the installation of a prior art high capacity hoist ring assembly 13 with the use of a torque multiplier 15 and conventional torque wrench 17 to achieve the proper tensile value in shank member 19. As used herein, a high capacity hoist ring assembly is one in which, to achieve proper installation, requires application of a torque value to the mount shank member of the assembly that cannot be easily achieved with a conventional torque wrench, if at all. Typically, hoist ring assemblies having a load capacity of 10,000 lbs and greater qualify as high load capacity hoist ring assemblies.

Referring to FIG. 1, for proper installation of the prior art high load capacity hoist ring assembly, the object to be lifted 29 is first provided with a threaded hole 21 and the shank member 19 threadably engages the threaded hole. The torque multiplier engages the shank member bolt head 23. The body of the torque multiplier must not rotate when torque is applied. This is extremely important in order to properly control the resultant torque since the multiplier includes an internal planetary gear system. Prevention of rotation is typically accomplished with the provision of a multiplier arm 25 and a multiplier stop 27 wherein the stop must engages an edge, slot, protrusion, or hole, of the object to be lifted. In FIG. 1, the stop 27 is shown to eventually engage an edge of the object, generally at 31, when the multiplier engages shank member bolt head 23. The conventional torque wrench 17 is then engaged into the torque multiplier input socket 33 to supply the input torque value. With the torque value selected on the torque wrench at scale 35, and knowing the multiplier ratio of the torque multiplier, the resultant torque applied to the shank member is controlled. Typically, the multiplier ratios needed for the installation of the high load capacity hoist ring assemblies range between about 5.1 to 1 to as high as 26.5 to 1.

Utilization of a torque multiplier to install high load capacity hoist ring assemblies has many disadvantages. These multipliers are bulky, heavy, and expensive compared to the hoist ring assemblies. They also require additional skill to operate and require additional installation pre-planning by the installer since the multiplier must engage an edge, slot, protrusion, or hole, to prevent rotation. Undesirably, the range of possible mounting locations on the object to be lifted is limited because the multiplier must engage some feature of the object to be lifted to prevent rotation. Finally, because of the high multiplier ratios, it can be quite easy to over torque a shank member by applying slightly too much input torque from the torque wrench. Many torque multipliers provide a square drive that shears off when too much torque is applied. Again, this is disadvantageous since, whenever over-torque is applied, the square drive of the multiplier breaks, requiring undesirable delay in the installation process.

Hydraulically-powered devices are also known in the art to provide the amount of torque necessary to load the shank member of a hoist ring assembly to a value not otherwise manually accomplishable. For example, such hydraulic tensioning devices can be found in U.S. Pat. Nos. 3,841,193; 3,886,707; 4,075,923; and 4,182,215. However, these devices also suffer the same disadvantages when used to install high capacity hoist ring assemblies as the torque multipliers. These devices are also bulky, heavy, and expensive compared to the hoist ring assemblies they are installing. Furthermore, rotational energy, derived from an electrical motor, internal combustion engine, or the like, is needed in order to produce the hydraulic pressure needed to operate the device. In addition, the hydraulic pressure must be precisely controlled in order to achieve the desired torque value within an acceptable tolerance range. Undesirably, hydraulic tensioning devices add even more expense, require even more skill to operate, and require even more installation pre-planning by the installer than do torque multipliers.

Referring now to FIGS. 2 through 5 wherein like reference numerals designate identical or corresponding parts throughout the several views, there is illustrated generally at 10*a* high load capacity hoist ring assembly capable of installation without the need of a torque multiplier or hydraulic tensioning device. The hoist ring assembly comprises, for example, a shank member 12, a compression member or bushing 14, a retainer flange 16, and a lifting loop 18 captively engaged between the shank member and the retainer flange. The hoist ring has a transversely disposed pivot structure, as discussed in Tsui et al. U.S. Pat. No. 5,848,815 herein incorporated by reference. Uniquely, the retainer flange 16 has a plurality of holes 20 at spaced apart locations about an outer peripheral 22 which receive a plurality of bolts 24 threadably engaging the holes. Each of the bolts 24 is adapted to separately receive a torque, and have separate jack ends 26 that extend through the holes to compressively bias the compression member upon installation of the assembly to an object to be lifted. Either socket cap screws or hex head screws may be used as shown, or equivalents, if desired. Uniquely, the torque requirements of each of these bolts is such that it can be achieved without the need of a torque multiplier while, in the aggregate, providing the required tensile value to the shank member.

Figure 2:
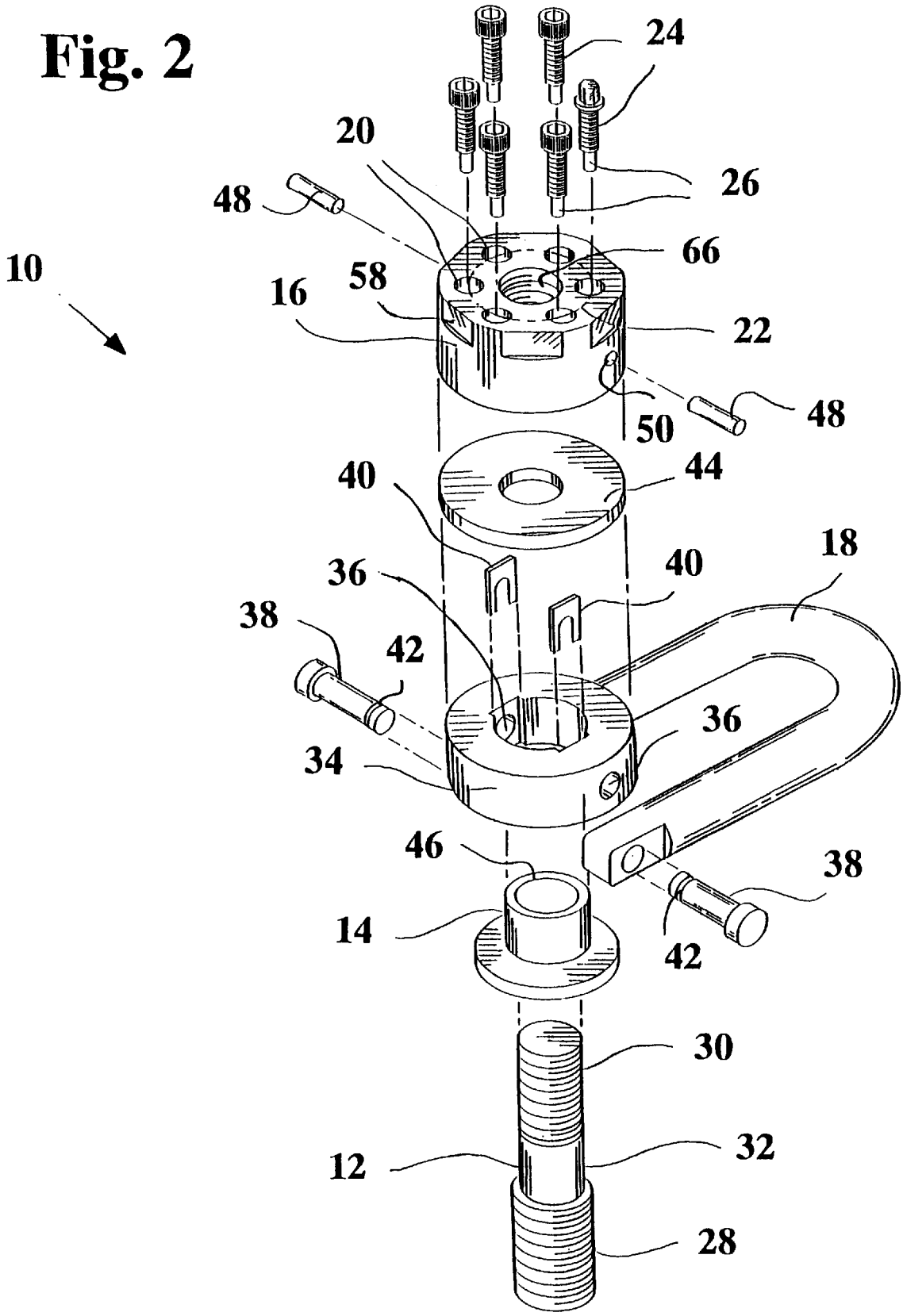
FIG. 2 is an exploded perspective view of a preferred embodiment of the invention.

In the preferred embodiment referred to for purposes of illustration only and not limitation, shown in FIG. 2, shank member 12 has a first threaded end 28 and a second threaded end 30 with an un-threaded portion 32, therebetween. The first threaded end 28 is adapted to threadably engage an object to be lifted. The first threaded end has a diameter that is greater than the diameter of both the un-threaded portion 32 and the second end 30. The second end threadably engages a central bore 66 in the retainer flange thereby captively engaging the lifting loop 18 to the assembly.

Retention ring 34 is mounted in captive swivel engagement with compression member 14 so as to allow it to rotate throughout substantially a full circle. The height of the cylindrical portion of the compression member or bushing 14 is greater than the thickness of the retention ring 34. The retention ring 34 includes pivot pin bores 36 which accept opposed pivot pin elements 38 and respectively pivotally join the lifting loop with the retention ring. The pivot pin elements are, for example, fixed in position with pin clips 40 that engage groves 42.

The high load hoist ring is assembled by inserting the shank member axially into the compression member 14. The retention ring 34 with the lifting loop 18, pivot pins 38, and pin clips 40 already installed, is then placed on the compression member. A thrust washer 44 is then provided which engages the second threaded end 30 and rests on the upper lip portion 46 of the compression member. Thrust washer 44 does not engage retention ring 34, thus permitting the retention ring to rotate through 360 degrees about the longitudinal axis of the assembly. The retainer member 16 is then threadably installed on the second threaded end 30. The assembly is made permanent when retainer dowels 48 are bindingly driven into openings 50 of the retainer flange and into engagement with the shank member 12.

Figure 3:
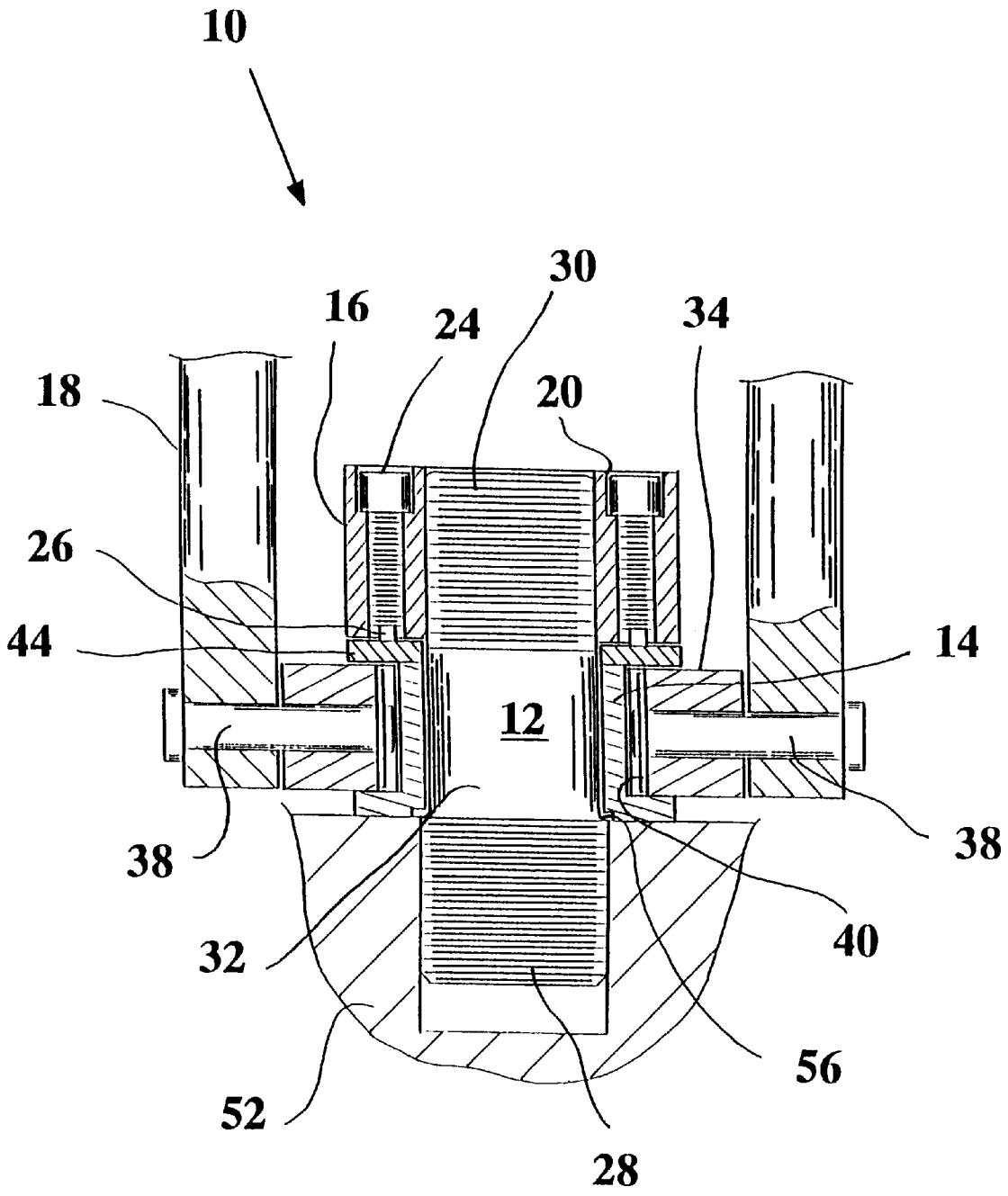
FIG. 3 is a cross sectional view of the preferred embodiment of FIG. 2 shown installed to an object to be lifted.

Unique to the present invention is the ability to install the high load capacity hoist ring at it's required tensile value without the use of a torque multiplier or hydraulic tensioning device. Shown in partial cross section in FIG. 3 is the embodiment of FIG. 2, but shown installed to an object to be lifted 52. It is desirable that the surface of the object be flat and smooth to provide a full 360 degree flush seating for the compression member, and that the threaded bore provided in the object be substantially perpendicular to the surface. The hoist ring assembly is installed to an object as follows. First, the retainer flange is rotated so that the first threaded end 28 of the shank member 12 engages threads provided in the object to be lifted. A hex pattern 58, shown in FIG. 2, is provided on the retainer flange 16 to assist the rotational initial engagement of the shank member to the object. It is important to note that, the required tensile value to be applied to the shank member is not achieved by applying a torque to the hex head retainer flange. The retainer flange is simply rotated until the assembly bottoms out on the object to be lifted. The bolts 24 are then turned until they evenly bottom out on the thrush washer 44. The required tensile value is applied to the shank member by the individual application of a torque at a predetermined value to each bolt 24 in the retainer flange. Preferably the torque is applied to each bolt in a star configuration. Referring to FIGS. 2 and 3, when a bolt 24 is torqued to its predetermined value, the jack end 26 of the bolt acts on the thrust washer 44, which in turn acts on the upper lip portion 46 of the compression member, which in turn acts against the surface of the object to be lifted. The load is transmitted past the retention ring by the generally cylindrical bushing 14 so that retention ring 34 remains free to rotate through 360 degrees about the longitudinal axis of the assembly. As each of the bolts 24 is torqued to a predetermined value, the force exerted by each bolt is additive, and the shank member becomes pre-stressed to the required tensile value. Preferably, the bolts are all initially turned until the jack ends engage the thrust washer, and then they are alternatively torqued in a star pattern to their final torque values.

Figure 4:
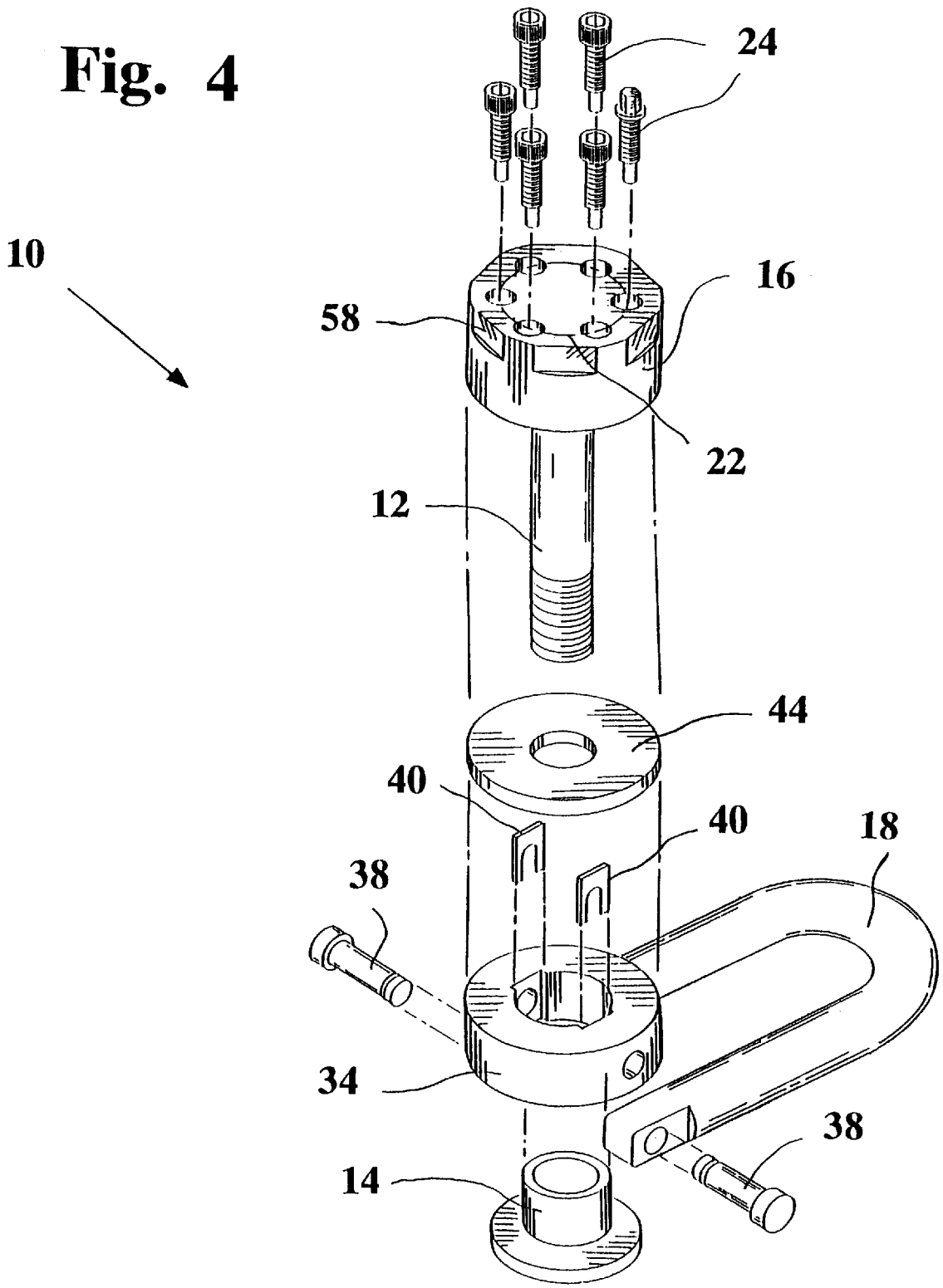
FIG. 4 is an exploded perspective view of another preferred embodiment of the invention.

Although the embodiments in FIGS. 2 through 4 include, for example, a thrust washer 44 biased between the jack ends of the bolts and the compression member, the thrust washer may be removed, if desired. Removal can be accomplished as long as the bolts are spaced apart in such a manner that their jack ends act generally symmetrically on the upper lip portion 46 of the compression member.

When the embodiment shown in FIGS. 2 and 3 is sized to achieve a load capacity rating of 50,000 lbs, the required torque value, or predetermined value, for the bolts is a mere 75 ft-lbs each. At this torque value, the six bolts achieve the required tensile value of 75,000 lbs in the shaft member. For this particular load capacity rating, the shank member first end 28 is a 2½"–8 UNC thread, the shank member second end 30 is a 2"–12 UNC thread, and the six bolts 24 have ½"–20 UNC threads. Amazingly, the six bolts need only be torqued to 75 ft-lbs to achieve the required stress value, preferably being 1.5 times the load capacity rating and at least as great as the load capacity rating. A comparable prior art hoist ring assembly having the same load rating of 50,000 lbs would require the application of a single torque of 2,100 ft-lbs with a torque multiplier to the shank member to achieve the required stress value.

It is preferred that the first threaded end 28 be larger than the second threaded end 30 and also larger than the un-threaded portion 32 in order to remove stress concentrations inherent to tensionally loaded threaded fasteners. Desirably, the transition 56 between the two diameter sizes should be blended, as shown in FIG. 2, to minimize stress concentrations and optimize the load capacity of the hoist ring for a given installation thread size. In addition, once the dowel pins 48 are bindingly installed, inadvertent disassembly of the hoist ring when unattached to an object is prevented. This "permanent" installation embodiment desirably eliminates the possibility of loosing any part when the assembly is not in use. However, this feature requires that the retainer flange be removable from the shank member with a threadable bore, or the like, so as to allow for initial assembly of the hoist ring parts on the shank member. Many such removable configurations can be used, if desired.

In the embodiment shown in FIG. 4, the retainer flange 16 is integral with the shank member 12. This configuration thereby eliminates the need to provide a threaded, or removable connection of these parts. In this configuration, the shank member has just one diameter to allow for assembly of the hoist member components. The components in this configuration are not permanently assembled and may be removed or replaced, as desired, whenever the assembly is not secured to an object to be lifted. The load rating capacity of this embodiment is slightly less than the load rating capacity of the embodiment shown in FIGS. 1 and 2 because the shank member has just one diameter, and this one diameter introduces stress concentrations at the location where the threads end adjacent the un-threaded portion. However, this embodiment has the advantage of being slightly less expensive than the previous embodiment due to the elimination of additional threading steps and dowel pins 48.

In the embodiments shown in FIGS. 2 through 4, six holes and six bolts are spaced apart about an outer peripheral circle 22.

Figure 5:
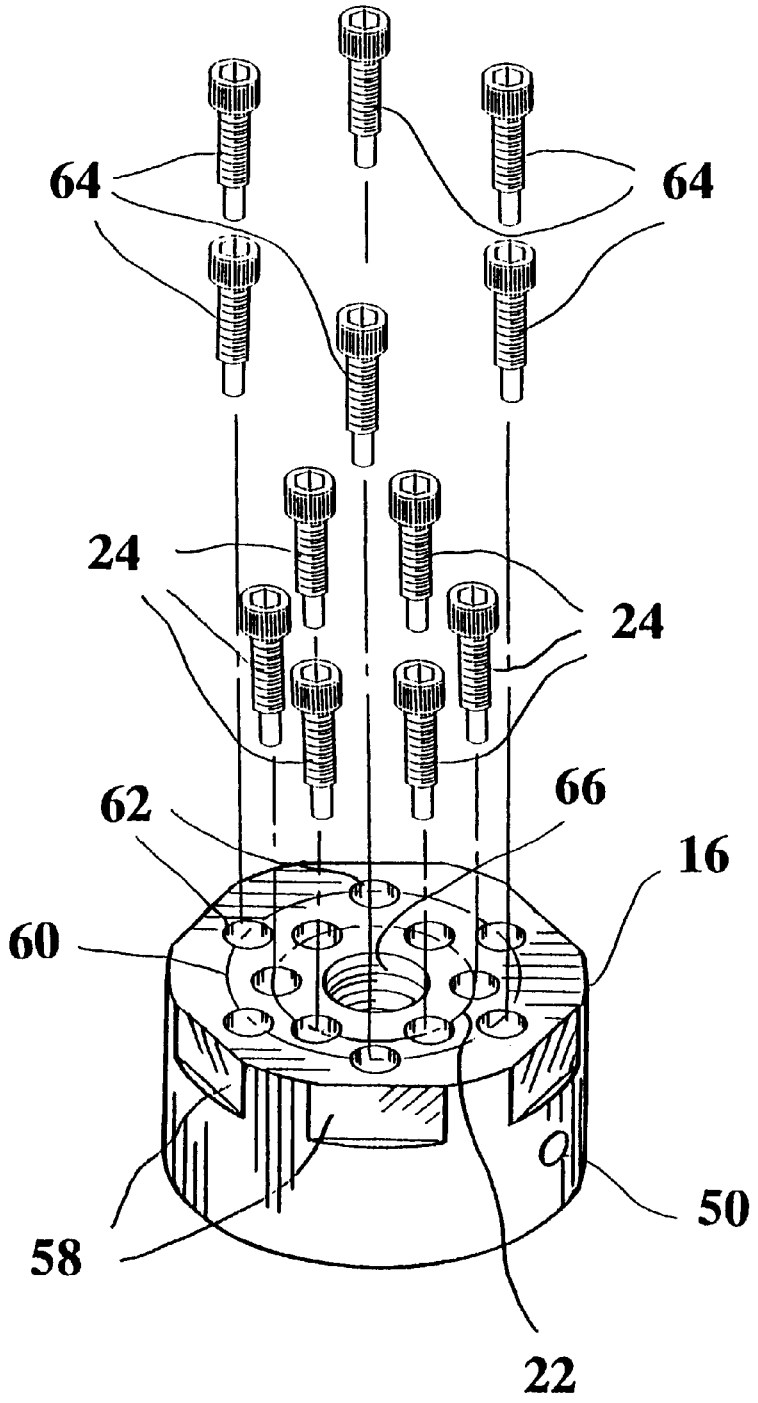
FIG. 5 is an exploded perspective view of an alternative retainer flange of the present invention.

More or less bolts may be used, if desired. Although they are spaced apart about an outer peripheral circle, other configurations may be used, such as, for example, a triangle or rectangle, as desired. Referring to FIG. 5, an alternative retainer flange is shown having an additional plurality of holes 62 at spaced apart locations, for example, on an additional outer peripheral circle 60 in a generally symmetrical array around the longitudinal axis of the assembly. Additional bolts 64 threadably engage additional holes 62. Other combinations may be used, as desired, to increase or decrease the number of bolts in the retainer flange as may be required to achieve the desired tension in the shank member without using torque multipliers. Additional outer peripheral locations having spaced apart holes for bolts may also be used, if desired. In general, it has been found that for most applications, utilizing just six bolts is sufficient to substantially reduce the required installation torque values and eliminate the undesirable necessity of using an expensive and bulky torque multiplier.

What has been described are preferred embodiments in which modifications and changes may be made without departing from the spirit and scope of the accompanying claims. Obviously many modifications and variations of the present invention are possible in light of the above teachings. It is therefore to be understood that, within the scope of the appended claims, the invention may be practiced otherwise than as specifically described.

What is claimed is:

1. A high load capacity hoist ring assembly adapted for installation to an object to be lifted at a required tensile value without the use of a torque multiplier or hydraulic tensioning device, said assembly comprising:

a shank member having a first end and a second end, said first end being adapted to engage said object;

a compression member adapted to being mounted against said object;

a retainer flange adapted to engage said shank member on said second end, a plurality of threaded holes at spaced apart locations in said retainer flange, said holes extending generally parallel to and spaced from said shank member;

a plurality of bolts adapted to threadably engage said holes of said retainer flange, said bolts adapted to separately receive a torque, said bolts being adapted to extend from said holes to compressively bias said compression member;

a lifting loop adapted to being captively engaged between said shank member and said retainer flange for rotational and pivotal movement; and wherein said bolts are adapted to being torqued to a predetermined value to pre-stress said shank member to said required tensile value.

2. A high load capacity hoist ring assembly of claim 1 further comprising:

a retention ring in captive swivel engagement with said compression member and adapted to rotate throughout substantially a full circle; and a transversely disposed pivot structure including opposed pivot pin elements respectively pivotally joining said lifting loop with said retention ring.

3. A high load capacity hoist ring assembly of claim 1 further comprising:

a thrust washer adapted to being disposed on said shank member between said compression member and said retainer flange wherein said bolt ends are adapted to engage said thrust washer and bias said thrust washer against said compression member when said bolts are torqued.

4. A high load capacity hoist ring assembly of claim 1 wherein said retainer flange and said shank member are one integral component.

5. A high load capacity hoist ring assembly of claim 1 wherein said retainer flange is adapted to threadably engage said second end of said shank member and said threadable engagement is adapted to being secured with at least one dowel bindingly driven through an opening in said retainer flange and into engagement with said shank member.

6. A high load capacity hoist ring assembly of claim 1 wherein both said shank member ends are threaded with an un-threaded portion therebetween, said threaded first end having a thread diameter greater than the diameter of said un-threaded portion.

7. A high load capacity hoist ring assembly of claim 1 having at least six said threaded holes in said retainer flange adapted to receive at least six said bolts.

8. A high load capacity hoist ring assembly of claim 7 having a load capacity rating of at least 10000 lbs.

9. A high load capacity hoist ring assembly of claim 1 wherein said required tensile value is at least equal to or greater than the load capacity rating of said hoist ring assembly.

10. A high load capacity hoist ring assembly of claim 1 further comprising:

an additional plurality of holes at spaced apart locations on a periphery of said retainer flange; and an additional plurality of bolts adapted to threadably engage said additional plurality of holes.

11. A hoist ring assembly having a load capacity rating of at least 10,000 lbs adapted for installation at a required tensile value to an object to be lifted, said tensile value being at least as great as said load capacity rating, said installation being capable of being accomplished without the use of a torque multiplier or hydraulic tensioning device, said hoist ring assembly comprising:

a shank member having a first threaded end and a second threaded end, said first threaded end being larger than said second threaded end and adapted to threadably engage said object;

a compression member having first and second ends and a bore adapted to slideably receive said second threaded end of said shank member, said bore being smaller than said first threaded end, said first end of said compression member being adapted to bear against said object when said assembly is installed;

a retention ring mounted for rotation about said compression member;

a lifting loop pivotally mounted to said retention ring;

a thrust washer adapted to being mounted on said shank member in load transmitting relationship to said second end of said compression member;

a retainer flange adapted to threadably engage said shank member on said second end, said threadable engagement being adapted to being secured with at least one dowel bindingly driven through an opening in said retainer flange and into engagement with said shank member, said retainer flange having a plurality of threaded holes at spaced apart locations about said flange;

a plurality of bolts threadably engaging said threaded holes of said retainer flange, said bolts adapted to separately receive a torque, said bolts being adapted to extend from said threaded holes against said thrust washer to compressively bias said compression member; and wherein said bolts are adapted to being torqued to a predetermined value to pre-stress said shank member to said required tensile value.

* * * * *

US006199925C1

(12) EX PARTE REEXAMINATION CERTIFICATE (7973rd)

United States Patent
Alba

(10) Number: US 6,199,925 C1
(45) Certificate Issued: Jan. 11, 2011

(54) HIGH LOAD CAPACITY HOIST RING

(75) Inventor: Tony J. Alba, West Covina, CA (US)

(73) Assignee: MJT Holdings LLC, Valdosta, GA (US)

Reexamination Request:
No. 90/006,784, Sep. 24, 2003

Reexamination Certificate for:

| | |
|---|---|
| Patent No.: | **6,199,925** |
| Issued: | **Mar. 13, 2001** |
| Appl. No.: | **09/339,466** |
| Filed: | **Jun. 23, 1999** |

(51) Int. Cl.
*B66C 1/66* (2006.01)

(52) U.S. Cl. ..... 294/1.1; 294/89; 403/78; 403/164

(58) Field of Classification Search ..... None
See application file for complete search history.

(56) References Cited

U.S. PATENT DOCUMENTS

| | | | | | |
|---|---|---|---|---|---|
| 3,297,293 | A | | 1/1967 | Andrews et al. | |
| 3,618,994 | A | | 11/1971 | Gepfert et al. | |
| 4,338,037 | A | | 7/1982 | Deminski | |
| 4,431,352 | A | * | 2/1984 | Andrews | 294/1.1 |
| 4,558,979 | A | * | 12/1985 | Andrews | 294/1.1 |
| 4,592,686 | A | * | 6/1986 | Andrews | 294/1.1 |
| 4,622,730 | A | * | 11/1986 | Steinbock | 492/1 |
| 4,705,422 | A | * | 11/1987 | Tsui et al. | 294/1.1 |
| 4,927,305 | A | | 5/1990 | Peterson, Jr. | |
| RE33,490 | E | | 12/1990 | Steinbock | |
| 5,075,950 | A | * | 12/1991 | Steinbock | 29/426.5 |
| 5,083,889 | A | * | 1/1992 | Steinbock | 411/432 |
| 5,466,025 | A | * | 11/1995 | Mee | 294/1.1 |
| 5,586,801 | A | | 12/1996 | Sawyer et al. | |
| 5,743,576 | A | * | 4/1998 | Schron, Jr. et al. | 294/1.1 |
| 5,823,588 | A | * | 10/1998 | Morghen | 294/1.1 |
| 5,848,815 | A | | 12/1998 | Tsui et al. | |
| 6,112,396 | A | * | 9/2000 | Steinbock | 411/432 |
| 6,612,631 | B1 | * | 9/2003 | Pearl | 294/1.1 |

OTHER PUBLICATIONS

Superbolt, Inc., "A New Force is Here" Catalog, May 1985.*
Superbolt, Inc., "A New Force is Here" Catalog, Jun. 1987.*
US Patent and Trademark Registration No. 1,399,031 of "Steinbock Machinery Corporation", Jun. 1986.*
US Patent and Trademark Registration No. 1,618,412 of "Steinbock Machinery Corporation", Oct. 1990.*

* cited by examiner

*Primary Examiner*—Andres Kashnikow

(57) ABSTRACT

A high load capacity hoist ring assembly that can be installed to achieve the required tensile value in the mounting shank member without the use of a torque multiplier or hydraulic tensioning device. The assembly comprises a shank member, a compression member, a lifting loop having a transversely disposed pivot structure captively engaged by a retainer flange. Uniquely the retainer flange includes a plurality of threaded holes adapted to accept bolts which when torqued with a conventional torque wrench combine to achieve the required tensile value in the mounting shank. Load Capacity ratings start at about 10,000 lbs and can well exceed 100,000 lbs.

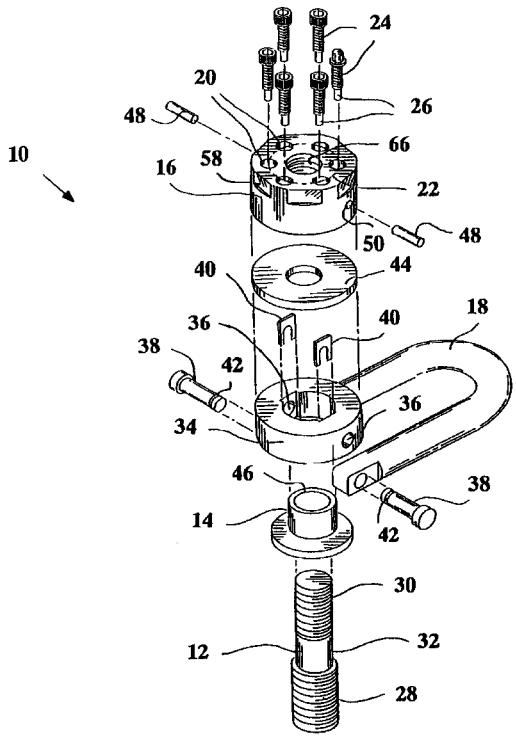

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-11 are cancelled.

* * * * *